United States Patent [19]

Swingler

[11] Patent Number: 4,668,890

[45] Date of Patent: May 26, 1987

[54] DYNODE STRUCTURE AND ARRAY FOR AN ELECTRON MULTIPLIER

[75] Inventor: Donald L. Swingler, Park Orchards, Australia

[73] Assignee: Commonwealth Scientific and Industrial Research Organization, Australia

[21] Appl. No.: 493,140

[22] PCT Filed: Aug. 25, 1982

[86] PCT No.: PCT/AU82/00138

§ 371 Date: Apr. 25, 1983

§ 102(e) Date: Apr. 25, 1983

[87] PCT Pub. No.: WO83/00772

PCT Pub. Date: Mar. 3, 1983

[30] Foreign Application Priority Data

Aug. 25, 1981 [AU] Australia ..... PF0423

[51] Int. Cl.[4] ..... H01J 43/10; H01J 43/20

[52] U.S. Cl. ..... 313/105 R; 313/533

[58] Field of Search ..... 313/535, 536, 533, 103 R, 313/104, 105 R

[56] References Cited

U.S. PATENT DOCUMENTS

| | | | |
|---|---|---|---|
| 2,147,825 | 2/1939 | Zworykin et al. | 313/533 X |
| 2,236,012 | 3/1941 | Shockley | 313/533 |
| 2,245,605 | 6/1941 | Pierce et al. | 313/105 R |
| 2,274,092 | 2/1942 | Pierce | 313/105 R |
| 3,619,692 | 11/1971 | Day | 313/536 X |
| 4,188,560 | 2/1980 | Swingler | 313/105 R |

FOREIGN PATENT DOCUMENTS

| | | | |
|---|---|---|---|
| 905762 | 1/1954 | Fed. Rep. of Germany | 313/105 R |

OTHER PUBLICATIONS

Rao, Narashimha, and M. S. Naidu, R. S. N. Rau, "A High Gain Aluminium Electron Multiplier", Journal of Physics E, Apr. 1975, vol. 8, No. 4, pp. 263–265.

*Primary Examiner*—Palmer C. DeMeo

*Attorney, Agent, or Firm*—Sughrue, Mion, Zinn, Macpeak and Seas

[57] ABSTRACT

The electron multiplier is of the kind in which a charge current is amplified by successive passage to and secondary emission of electrons from dynodes which are arranged in two opposed rows. The multiplier is arranged for application of electric charge to the dynodes so as to focus the charge current on to each of the dynodes in succession, alternating between the rows. The dynodes have electron emissive surfaces to which the charge current passes and angled flanges located at opposite edges of the surfaces. The surfaces are preferably formed by aluminum foil. The rows of dynodes are preferably formed by aluminum foil. The rows of dynodes are supported on opposed cantilevered insulating members by crimped straps.

19 Claims, 12 Drawing Figures

FIG 5
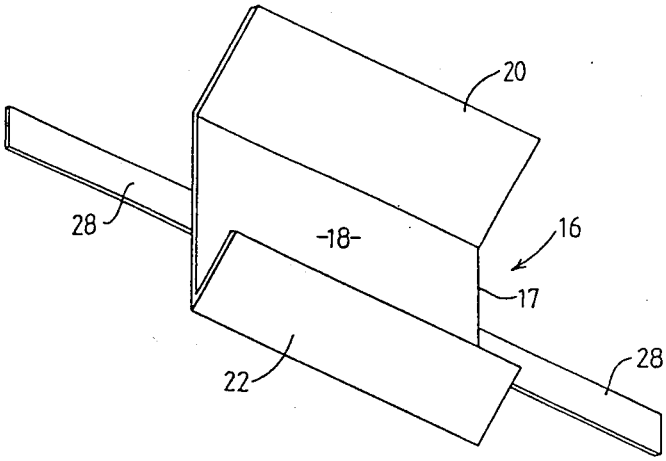
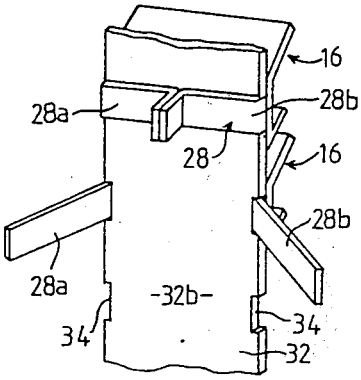
FIG 6

FIG 9
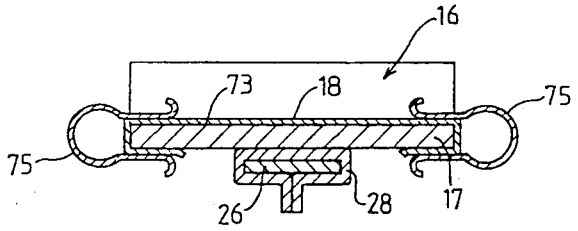
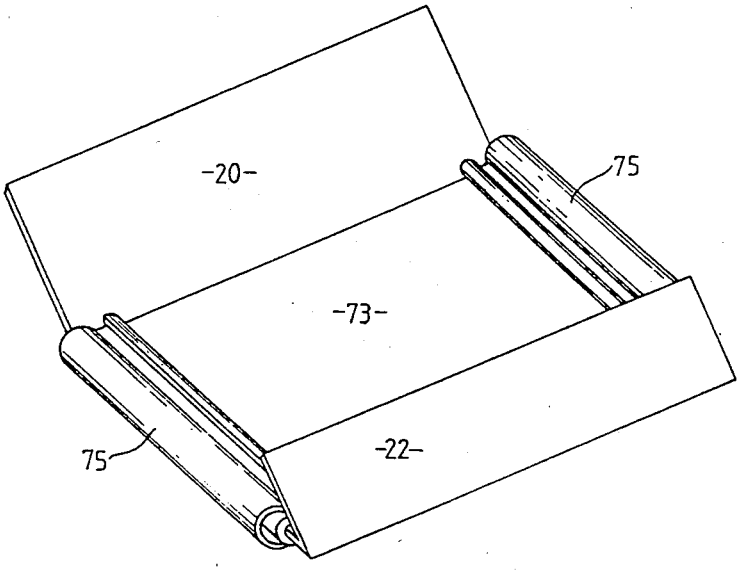
FIG 10

DYNODE STRUCTURE AND ARRAY FOR AN ELECTRON MULTIPLIER

BACKGROUND OF THE INVENTION

This invention relates to electron multipliers of the kind in which a charge current is amplified by passage to and by secondary emission of electrons from surfaces of a dynode array, and to dynode arrays for such electron multipliers. In one aspect, the invention is particularly concerned with electron multipliers in which there are two generally parallel rows of said dynodes in said array, the dynodes in each row being in side-by-side position, and said successive dynodes being dynodes in alternating ones of said rows, each said dynode being shaped such that electric potentials which are applied to the dynodes of the array generate an electric field between the two rows such as to effect substantial direction of secondary electrons produced at each said surface to the surface of the next successive dynode; in which said dynodes in one said row have the said surface thereof facing the other said row of dynodes and those of the other said row have the said surface thereof facing said one row; each said dynode having first and second flanges bounding respective opposed margins thereof, said first and second flanges extending transverse to the directions of extent of said rows, the flanges of dynodes in said one row extending from the surfaces of those dynodes towards the other said row and the flanges of dynodes of said other row extending from the surfaces of those dynodes towards said one row, and each adjacent pair of said dynodes in said one row and in said other row having the first flange of one dynode of the pair adjacent and spaced from the second flange of the other dynode of the pair, and the first flange of each said dynode being closer to an input end of the array than the second flange of that dynode; the surfaces of dynodes in said one row and of dynodes in said other row being linear and parallel to the lengthwise direction of extent of the respective row, when the array is viewed in lengthwise cross-section normal to tangents to said surfaces at the location of the cross-section.

Our Australian Patent Specifications AU 39194/78 and AU 87312/75 describe electron multipliers of the above kind. In these constructions, the aforementioned first flange is of generally L-shaped configuration having a first portion which extends normally to the respective dynode surface and an outwardly extending second portion which extends away from the edge of the first portion remote from the dynode surface in a plane parallel to the dynode surface. The second flange extends normally from the associated dynode surface.

While the arrangements of patent specifications AU 39194/78 and AU 87312/75 have proven to be highly satisfactory in use, the two portion form of the first flanges renders the manufacture of the dynodes less simple than would be desirable. In accordance with a first aspect of the invention, this difficulty is avoided in that the first flange of each said dynode extends at an obtuse angle to the surface of that dynode, to extend away from that surface towards said input end, and the second flange of each said dynode extends at an acute angle to the surface of that dynode, from the junction of the flange with that surface, towards said input end.

In order to secure effective operation of electron multipliers, the surfaces of the dynodes to which the charge current is directed must be selected so as to have good emissive characteristics in the sense that a high secondary electron yield is obtained on incidence of an electron.

The performance of emissive surfaces deteriorates during long term use of dynodes, so that the lifetime of an electron multiplier has been, hitherto, usually limited to the lifetime of the emissive surfaces. In Australian Patent Specification AU 39194/78, a construction of cylindrical multiplier is disclosed in which the emissive surfaces are defined on strip metal which is removable from the dynodes so as to provide a construction where the life of the multiplier can be rendered indefinite by replacement of the strips as necessary. However, it is necessary in that construction to pre-form the strips to a specific configuration, such as by some suitable hand or machine process involving cutting as well as bending. Also the method of retention of the strips has rendered their replacement less simple than would be desirable. In another aspect, then, the invention seeks to provide a construction which, whilst providing the advantages of removable dynode surfaces, permits of a simplified removal and replacement procedure. In this aspect, then, the invention provides a dynode array for an electron multiplier in which a charge current is amplified by passage to and secondary emission of electrons from surfaces of successive dynodes of the array, characterised in that the emission surfaces of the dynodes are defined by foils removably positioned on supporting portions of the respective dynode. In a preferred form of the invention the foils are aluminum foils which have, unexpectedly, been discovered to have good secondary emission characteristics.

BRIEF DESCRIPTION OF THE DRAWINGS

The invention is further described by way of example only with reference to the accompanying drawings in which:

FIG. 5 is a perspective view of a dynode incorporated into the multiplier of FIG. 1;

FIG. 6 is a scrap perspective view showing the manner of attachment of dynodes in the multiplier of FIG. 1;

FIG. 9 is a transverse cross-section of a dynode like that shown in FIG. 5, but having the emissive surface thereof defined by a removable foil;

FIG. 10 is a perspective view of the dynode of FIG. 9;

DETAILED DESCRIPTION OF THE INVENTION

Figure 1:
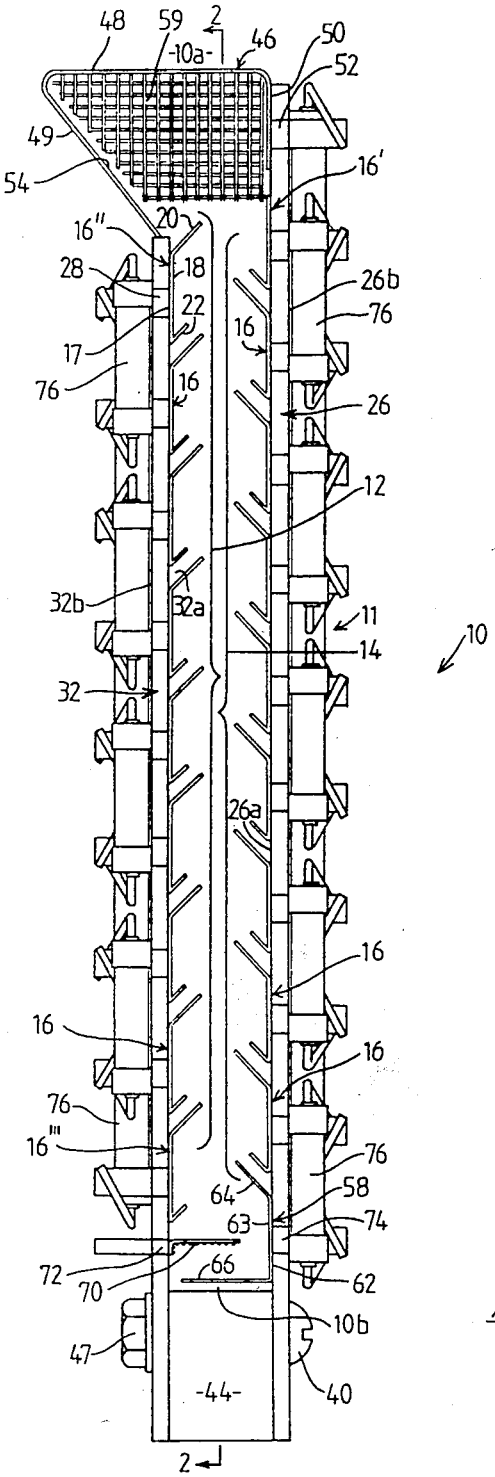
FIG. 1 is a side view of an electron multiplier constructed in accordance with this invention.
Figure 2:
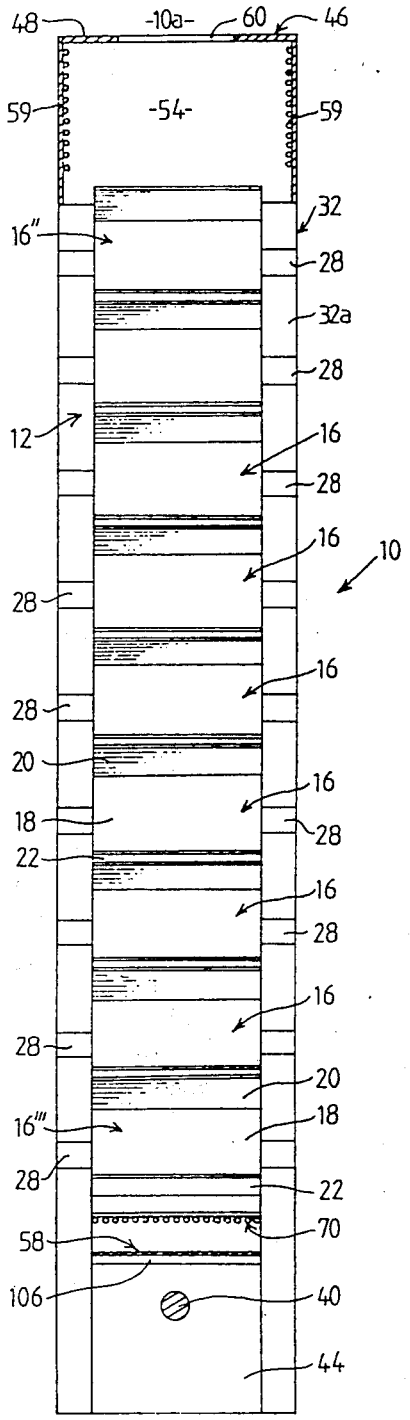
FIG. 2 is a cross-section substantially on the line 2—2 in FIG. 1.
Figure 3:
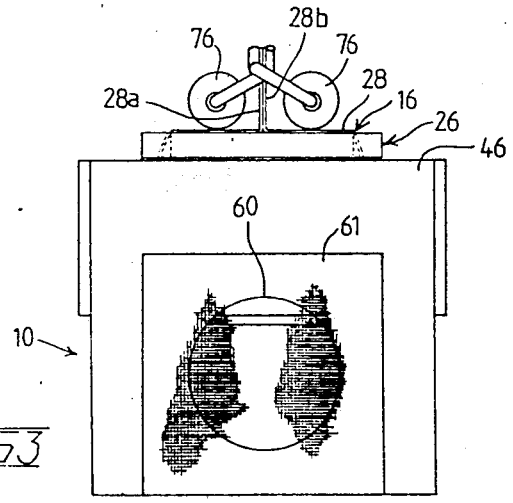
FIG. 3 is a top view of the multiplier of FIG. 1.

The electron multiplier 10 of FIGS. 1 to 3 has a dynode array comprised of two rows 12, 14 of dynodes which rows extend generally parallel to each other from an input end 10*a* of the multiplier to an output end 10*b*. Aside from end dynodes described later, the dynodes in each row are generally similar being of the form of the dynode 16 illustrated in FIG. 5. More particularly, each dynode 16 has a planar portion 17 defining a planar secondary emission surface 18 of rectangular form and first and second flanges 20, 22 which extend along opposed side margins of the surface 18. Flange 22 extends at an acute angle to surface 18, being reversely bent to overlie the surface 18. Flange 20 is bent so as to form an obtuse angle relative to surface 18 and is generally parallel to flange 22. As shown, each flange is at an angle of 45° to the direction of extent of the surface 18 when viewed from the side as shown for example in FIG. 1. The flange 20 is somewhat larger than flange 22, being longer as viewed from the side such as in FIG. 1. The dynodes 16 may be formed from a rectangular blank of sheet metal by simple folding operations to form the flanges 20, 22 and portion 17.

Except for an input dynode 46 described later, the dynodes 16 in row 12 are supported on an insulating member 32 by means of thin metal straps 28 secured to reverse faces of the dynode portions 17. The dynodes 16 in row 14 are likewise assembled in analagous fashion on to a supporting insulating member 26, which member 26 also carries dynode 46.

The members 26 and 32 are formed from insulating material such as alumina, being of rectangular planar elongate form. As shown in FIG. 6 member 32 has a series of cut-outs or notches 34 formed in the side edges thereof, the notches being aligned in opposed pairs along the length of the member. The member 26 is similar, having a similar series of notches 34 in the side edges. The dynodes 16 are supported on the respective member 26 or 32 with the reverse surfaces of portions 17 parallel to and overlying one major face 26*a*, 32*a* of the respective member 26 or 32. The straps 28 are thus positioned between the reverse faces of the dynode portions 17 and the respective member 26 or 32. Opposed arm portions 28*a*, 28*b* of the straps 28 thence extend transversely across the major face 26*a* or 32*a* of the respective member 26, 32 into the notches 34 and thence along outer faces 26*b*, 32*b* of the members 26, 32. At the outer faces, the opposed ends of each strap are crimped and spot-welded together in a fashion such as to apply tension to the arm portions 28*a*, 28*b* to tightly hold the dynodes in position.

The notches 34 are of width, measured in the lengthwise direction of the members 26, 32 only slightly greater than the width of the straps 28 and thus serve to accurately locate the straps and affixed dynodes in position. This method of affixment results in the dynode surface 18 of each dynode being maintained with a high degree of accuracy generally parallel to the direction of extent of the members 26, 32 and provides for accurate spacing of the dynodes along the lengths of the members.

As best shown in FIG. 1, the dynodes 16 in each row 12, 14 are arranged on the members 26, 32 such that the flanges 20 are in each case closest to the input end 10*a* of the multiplier 10 and the flanges 22 closest to the output end 10*b* thereof. The flanges 20, 22 thus extend from the surface 18 of the dynode of which they form part inwardly towards the dynodes of the opposed row and towards the input end of the multiplier. The arrangement results in the flange 22 of each of the dynodes of each row, save for the last or output end dynodes in each row, being adjacent and parallel to, and spaced from, the flange 20 of the immediately adjacent dynode.

At locations towards the output end of the multiplier, the members 26, 25 are secured together by means of a screw 40 which passes through openings in the members 26, 32 and through an intervening spacer member 44 formed of insulating material. Screw 40 has a nut 47 on the end thereof opposite the screw head and the nut and screw are tightened up to hold the members 26 and 32 firmly in position so as to extend in parallel cantilevered relationship away from the member 44. The positioning of the last-mentioned holes in the members 26, 32 is such that the dynodes in row 12 are not positioned in direct opposition to the dynodes in row 14, but are displaced by a distance equal to one-half of the pitch distance between dynodes in each row, reckoned in the directions of extent of the rows.

Row 14, by virtue of the above-described arrangement, has an input end dynode 16, designated by reference 16' which is furthest from the output end of all dynodes in that row and is the first of the dynodes 16 in the array. As mentioned, there is, however, an input dynode 46 forming part of row 12, and it is this dynode which first receives input signal in use of the multiplier. Dynode 46 is of inverted U-shaped configuration formed by folding of a generally rectangular blank so as to present a top planar portion 48 which extends transversely across the input end of the multiplier and two opposed planar arm portions 49 and 50. Arm portion 50 is at an angle of approximately 90° to portion 48 and carries a strap 52, like the straps 28 of the dynodes 16, by means of which the dynode 46 is secured to insulating member 26. Arm portion 49 extends at an angle of approximately 45° to portion 48 and, in position as shown in FIG. 1, extends from the free edge of portion 48 remote from flange 50, and from a location well outboard of member 32 and dynodes 16 of row 12, towards the output end 10*b* of the multiplier and inwardly to terminate at a location immediately adjacent, but spaced from, the junction between the flange 20 and the surface 18 of the first dynode 16 (shown by referenced numeral 16'' in FIG. 1) in row 12. Portion 49 has a dynode surface 54 at the surface thereof which is directly opposed to flange 50.

Portion 48 of dynode 46 has a central aperture 60 (FIG. 3) which is covered by fine "micromesh" 61 (Trade name for E.M.I. fine mesh) (preferably having 100 meshes per 25 millimeters lineal). As described later, electrons or other charged particles can enter the multiplier via aperture 60 to impinge on surface 54 for direction on to dynode 16'.

Dynode 46 also carries two opposed electrostatic shields 59 formed of mesh material which close opposed sides of the electrode.

Towards the output end of the multiplier, the member 26 carries an additional dynode 58, forming part of row 14 and which differs in form from the dynodes 16. Dynode 58 has an intermediate portion 62 and two opposed flanges 64, 66 formed by folding of a metal blank. Flange 64 is of the same form as flanges 20 on dynodes 16, and portion 62 defines a dynode surface 63 similar to dynode surfaces 18. The flange 66 is longer than flange 64 when viewed from the side as in FIG. 1 and of length, measured away from the junction with portion 62, which is only slightly less than the distance between the two rows 12, 14 of dynodes. Flange 64 extends at an angle of about 45° relative to portion 62. As shown in FIG. 1, the dynode 58 is positioned so that the dynode surface 63 thereof is located so as to constitute an extension of the row of dynode surfaces 18 on dynodes 16 in row 14 and with the flange 64 arranged to extend in parallel relationship but spaced from the flange 22 of the immediately preceding dynode 16 in row 14. The flange 66 of the dynode 58 extends transversely across the space between the two rows of dynodes, from the row 14 to a location just short of the member 32.

The location of flange 66 is such that it is positioned further from the input end of the multiplier than the flange 22 of the last dynode 16''' in row 12. Between the last dynode 16''' in row 12 and the flange 66, there is positioned a collector 70 of mesh material which is secured to member 32 to extend transversely of the multiplier and in generally parallel overlying relationship to the flange 66.

Collector 70 and dynode 58 are held on to respective members 32, 26 by straps 72, 74 respectively, in the same manner as the dynodes 16 are held to the members 32, 26.

Figure 4:
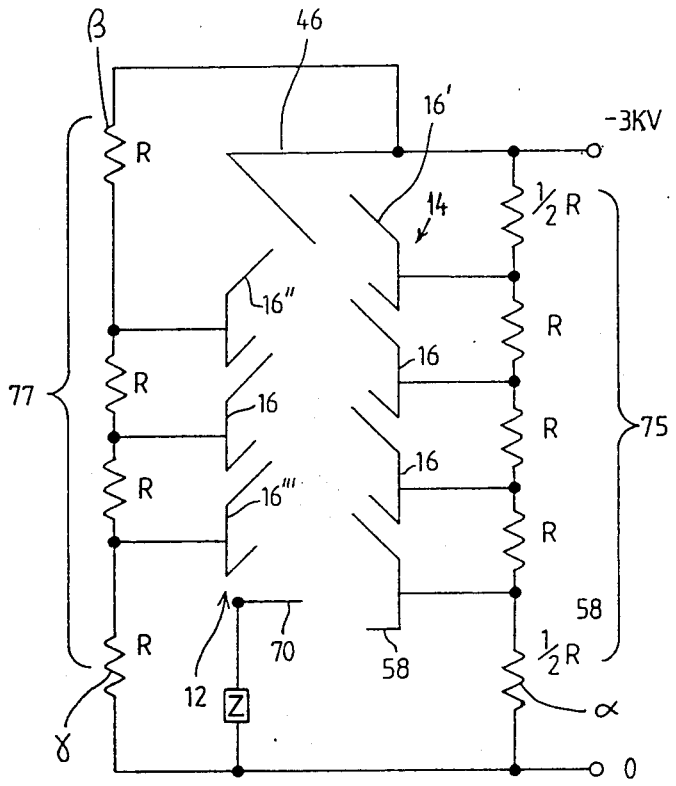
FIG. 4 is a circuit diagram showing electrical interconnections made to the multiplier of FIG. 1 in use.

The mode of electrical interconnection of the dynodes 16, 46 and 58 is shown in FIG. 4. The dynodes 16 and 58 of row 14 are interconnected to each other and across an electrical supply (not shown) by a chain 75 of resistors, the resistors between each pair of dynodes being of value "R" and those between the supply and the dynodes 16' and 58 being of value R/2. Similarly, the dynodes 16 and 46 of row 12 are interconnected to each other and across the supply by a chain of resistors 77 including resistors each of value "R". The end resistors of chain 77 connect the end dynodes 46, 16''' of row 12 to the supply. The resistors in chains 75 and 77, save for those marked "$\alpha$" "$\beta$" and "$\gamma$" in FIG. 4 are shown by reference numerals 76 in FIG. 1, being mounted on the multiplier itself. The resistors of the chains 75 and 77 marked "$\alpha$" "$\beta$" and "$\gamma$" are externally provided, although of course this is not essential. The crimped together ends of the arms 28*a*, 28*b* of the straps 28 and corresponding crimped together ends of the straps associated with dynode 46 and dynode 58 are used as terminal posts for electrical connection of resistors 76.

Figure 7:
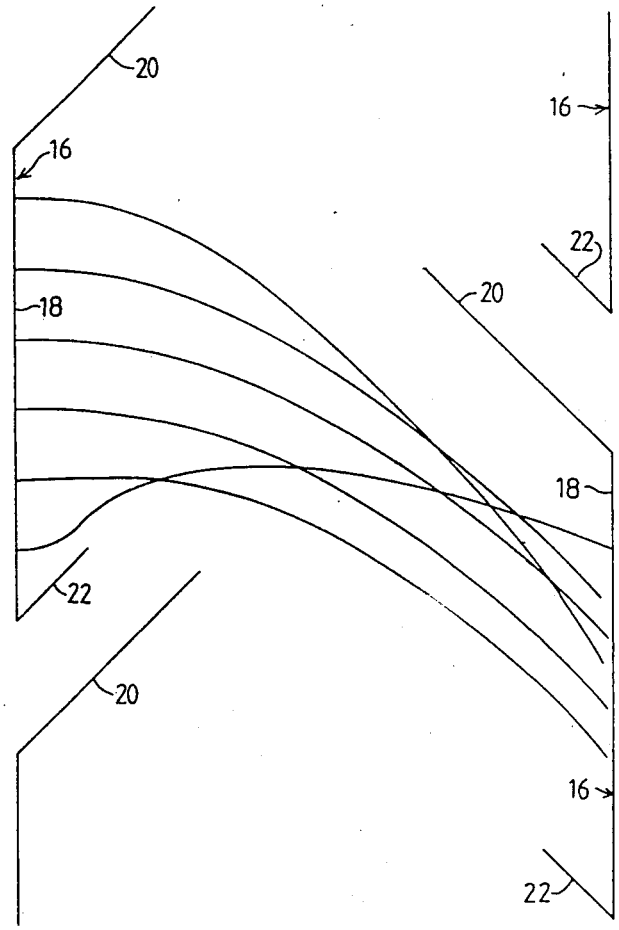
FIG. 7 is an electron trajectory diagram illustrating the performance of the multiplier of FIG. 1.

In use, an electrical potential is applied across the two chains in parallel so as to apply to the dynode 16, the dynodes 46 and 58 and the collector 70 electric potentials which gradually become more positive from the dynodes 16'' and 46 along each row to the collector. For example, as shown in FIG. 4, a negative potential of 3000 volts may be applied to dynode 46 and zero potential may be applied to the collector 70. FIG. 4 is to be taken as a potential diagram illustrating the "rest" potentials applying in use of the multiplier. As is well known in conventional practice a substantial impedence Z must prevail between the collector 70 and the zero or ground potential, across which impedence the output of the multiplier is developed. The arrangement of the values of the resistors as described above results in the first dynode 46 being at a somewhat greater negative potential than the first dynode 16' in the row 14 and, viewed along the length of the multiplier, there is defined a path of gradually more positive going potential from one successive dynode to the next through the multiplier with successive dynodes being alternately in row 12 and row 14. This results in a distribution of electrical charge between the successive dynodes and, as shown in FIG. 7, this electrical charge acts to focus secondary electrons from successive dynodes in the multiplier on to the next following one until the last dynode surface 63 is reached, from which secondary electrons are passed to collector 70. Charged particles, for initiating a charge current through the multiplier can pass into the multiplier through aperture 60 in dynode 46.

The described configuration for the dynodes has been found to be particularly satisfactory in use and provides good focusing of secondary electrons through the multiplier. Departures in the relative angle of the flanges of the dynodes from the 45° angle mentioned to angles between 40° to 50° do not cause serious impairment of this focusing ability.

The dynode surfaces of the dynodes may be formed in a conventional fashion such as from beryllium-copper or silver-magnesium material treated in accordance with usual practice. Alternatively, they may comprise aluminium containing materials. The material, whether it be aluminium containing material, beryllium-copper or silver-magnesium may be in the form of a flexible foil 73 applied over the dynodes and held in place such as by clips 75 as shown in FIGS. 9 and 10. The clips 75 are not, however essential, in most instances merely folding margins of the foil back around the opposed edges of the dynode portions 17 is sufficient to hold the foil in place.

Surprisingly, it has been found that commercial aluminum foils form good secondary emission materials. Particularly, referring to FIG. 12, there is shown therein a plot of secondary electron yield ($\delta$) against incident energy for three emissive materials. The secondary electron yield is the ratio of charge current leaving the emissive surface to the incident charge current. Generally, the yield varies over a range of incident energies.

Figure 12:
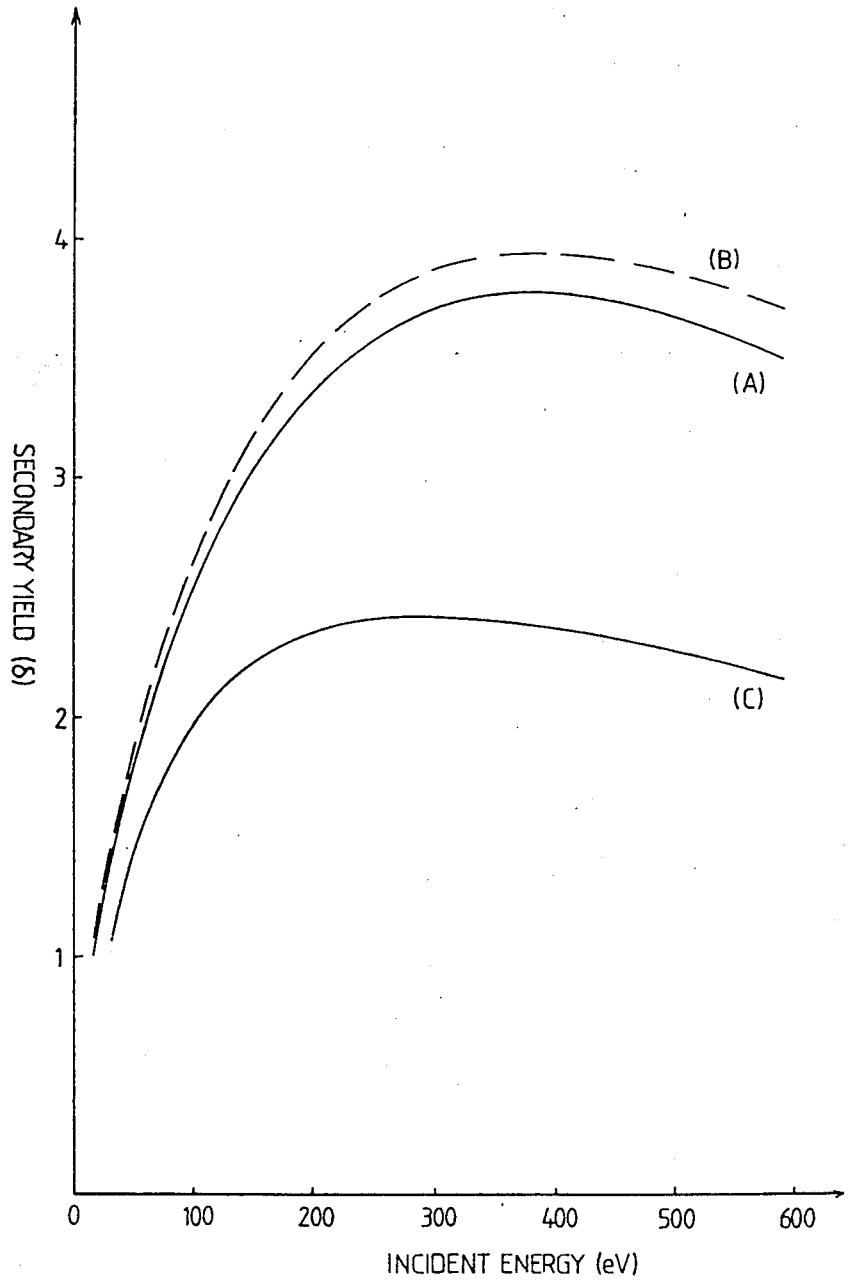
FIG. 12 is a graph illustrating the performance of various dynode emissive surfaces.

In FIG. 12, the plot C is a plot of secondary electron yield against incident energy for a commercial beryllium-copper emissive material. The yield $\delta$ exhibits a peak in the range 200–300 eV at which $\delta$ has a magnitude of about 2.4. Plots A and B in FIG. 12 are plots for two aluminium foil emissive materials. The materials were commercially available aluminium foil of thickness 0.017 mm, being that marketed in Australia by Comalco Limited bearing international registered designation 1145. This foil is formed by rolling a double sheet, resulting in a highly polished roller contact surface and a dull aluminium to aluminium surface for each of the separated sheets. After rolling, the material is, during manufacture, heat treated at 350° C. for between one-half an hour and two hours.

The plot A of FIG. 12 represents the variation of yield $\delta$ against incident energy for the aforementioned aluminium foil when the highly polished surface thereof was used as the emissive surface whilst plot B represents the corresponding variation for the material when the dull surface was used as the emissive surface. Thus, the highly polished surface exhibited greatly increased peak yield (of approximately 4) as compared with the aforementioned beryllium-copper material whilst substantial improvement over the beryllium-copper material was also achieved using the dull surface. However, with the dull surface used, the peak yield obtained was somewhat less than that obtained using the highly polished surface, being of the order of 3.8.

Figure 8:
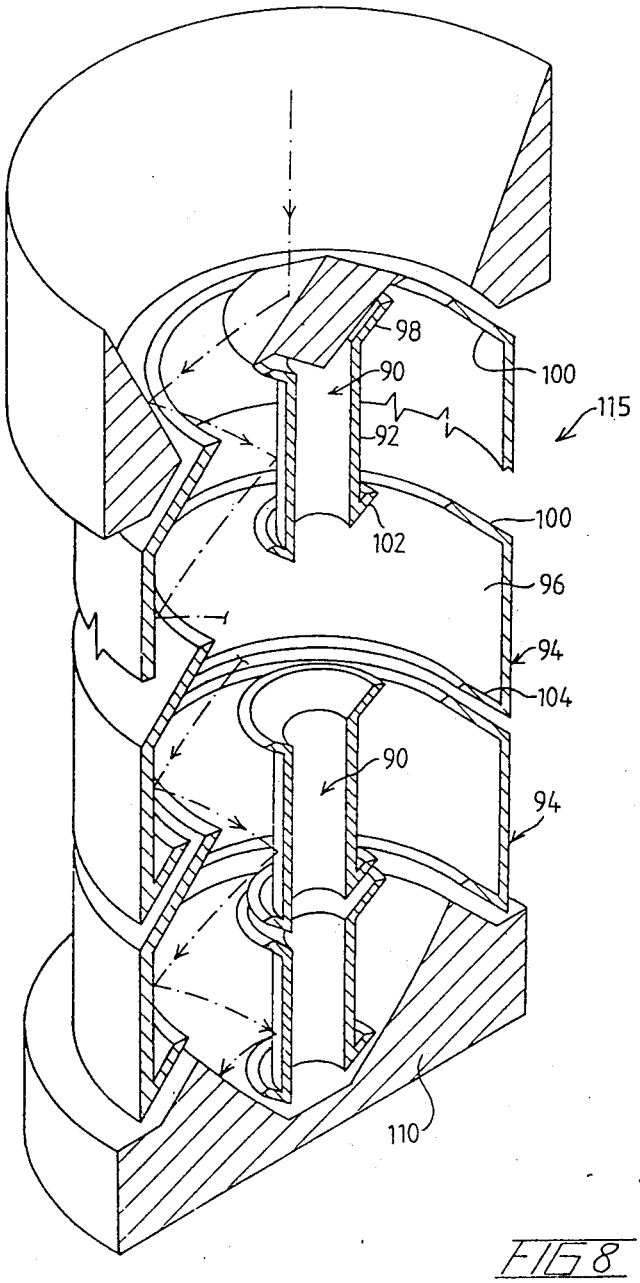
FIG. 8 is an axially sectioned view of a modified electron multiplier constructed in accordance with the invention.

The arrangement of the multiplier of FIG. 1 can be varied to form a cylindrical electron multiplier such as the multiplier 115 shown in FIG. 8. In this multiplier, the dynodes 90 in one row are cylindrical, the dynode surfaces 92 being defined on an outer surface thereof, whilst the dynodes 94 in the other row are cylindrical with dynode surfaces 96 defined on inner surfaces thereof. The two rows are arranged coaxiallly. Each dynode has an annular flange 98 or 102 at one end and an annular flange 100 or 104 at the other end these representing a configuration, when viewed in axial section of the multiplier, corresponding to the side configuration of the flanges 20, 22 of the construction of FIG. 1. An annular collector 110 is provided at the output end of the multiplier 115. In use, then, the multiplier of FIG. 8 functions in the same fashion as that shown and described previously in relation to multiplier 10, the path of charge current through the multiplier being as shown by arrows 108 in FIG. 8.

Figure 11:
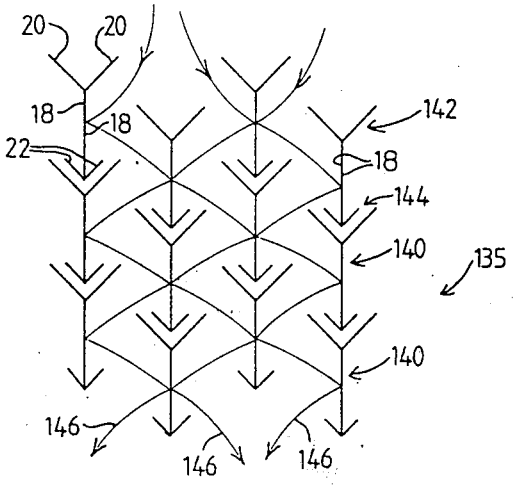
FIG. 11 is a diagram illustrative of further modification of the invention.

FIG. 11 is a diagram showing a still further modification in which a multi-channel multiplier 135 is constructed by using dynode forming bodies 140, each body having a planar portion defining two dynode surfaces 18, one to either side and having end portions 142; 144, each defining a respective pair of flanges 20;22. Paths of charge current flow through the parallel multiplier channels defined by the bodies 140 are designated by reference numerals 146.

I claim:

1. A dynode array for an electron multiplier of the kind in which a charge current is amplified by passage to, and by secondary emission of electrons from, surfaces of successive dynodes of the dynode array, there being two generally parallel rows of said dynodes in said array, the dynodes in each row being in side-by-side position, and said successive dynodes being dynodes in alternating ones of said rows, each said dynode being shaped such that electric potentials which are applied to the dynodes of the array generate an electric field between the two rows such as to effect substantial direction of secondary electrons produced at each said surface to the surface of the next successive dynode; in which said dynodes in one said row have the said surface thereof facing the other said row of dynodes and those of the other said row have the said surface thereof facing said one row; each said dynode having first and second flanges positioned at opposite sides of said surface thereof, said first and second flanges extending transverse to the directions of extent of said rows, the flanges of dynodes in said one row extending from the surfaces of those dynodes towards the other said row and the flanges of dynodes of said other row extending from the surfaces of those dynodes towards said one row, and each adjacent pair of said dynodes in said one row and in said other row having the first flange of one dynode of the pair adjacent and spaced from the second flange of the other dynode of the pair, and the first flange of each said dynode being closer to an input end of the array than the second flange of that dynode; the surfaces of dynodes in said one row and of dynodes in said other row being linear and parallel to the lengthwise direction of extent of the respective row, when the array is viewed in lengthwise cross-section normal to tangents to said surfaces at the location of the cross-section; characterized in that said first flange of each said dynode extends at an obtuse angle to the surface of that dynode, to extend away from that surface towards said input end, and the second flange of each said dynode extends at an acute angle to the surface of that dynode, from the junction of the flange with that surface towards said input end, said first flange of said one dynode of each adjacent pair of said dynodes being generally parallel to the second flange of the other dynode of the pair.

2. A dynode array as claimed in claim 1, wherein said flanges, when viewed in said cross-section, extend at an angle in the range 40° to 50° to the directions of extent of said rows.

3. A dynode array as claimed in claim 1, wherein said first flanges are longer, when viewed in said cross-section, than the second flanges.

4. A dynode array as claimed in claim 2, wherein said first flanges are longer, when viewed in said cross-section, than the second flanges.

5. A dynode array as claimed in any one of the preceding claims wherein said surfaces and said flanges are generally planar.

6. A dynode array as claimed in any one of claims 1 to 4, wherein said surfaces and said flanges are generally annular with the dynodes of said one row having said surfaces in coaxial relationship to said surfaces of the dynodes of the other row.

7. A dynode array as claimed in claim 1, wherein the dynodes of said one row are fixed in spaced relationship along the length of a first insulating member, and the dynodes of said other row are fixed in spaced relationship along the length of a second insulating member, said insulating members extending in parallel spaced relationship and in the directions of extent of the respective rows.

8. A dynode array as claimed in claim 7, wherein each dynode is affixed by a flexible strap to its respective insulating member.

9. A dynode array as claimed in claim 8, wherein said surface and the flanges of each dynode are formed on a respective dynode structure having a said strap thereof secured to a face of the structure opposite the said surface, said straps of each dynode extending around the said respective insulating member.

10. A dynode array as claimed in claim 9, wherein each said insulating member is elongate and generally planar with the dynodes affixed thereto arranged so that the said opposite faces thereof are positioned in overlying relationship to one major face of the respective insulating member, the said straps being interposed between said opposite faces of the dynodes and the said one face of the respective insulating member, and defining strap arms extending oppositely from each other from the respective said opposite dynode face and around opposed edges of the respective insulating member to strap arm ends secured together at a second face of the respective insulating member which is opposite said one face.

11. A dynode array as claimed in claim 9, wherein the insulating members have opposed notch portions along the edges thereof to receive and locate the said straps where these pass around the edges of the insulating members.

12. A dynode array as claimed in claim 7, wherein the two insulating members are secured together at respective adjacent one ends thereof only.

13. A dynode array for an electron multiplier of the kind in which a charge current is amplified by passage to, and by secondary emission of electrons from, emissive surfaces of successive dynodes for the dynode array, each said dynode being shaped such that electrical potentials which are applied to the dynodes of the array generate an electric field between successive dynodes such as to effect substantial direction of secondary electrons produced at each said emissive surface to the emissive surface of the next successive dynode wherein each said dynode is in the form of a rigid conductive support structure provided with means for making electrical connection to the respective dynode, and an electrically conductive flexible foil detachably mounted in coplanar relationship with an underlying portion of the support structure, said foil defining, at an outermost surface thereof, the emissive surface of the respective dynode, each said support structure further defining at least one further rigid portion defining, for the associated dynode, a conductive surface extending at an angle to the emissive surface of that dynode to focus electrons onto that emissive surface.

14. A dynode array as claimed in claim 13 wherein said emission surface is planar and margins of each foil are wrapped around respective opposed edges of said underlying portion of the respective dynode structure to locate the foils in position.

15. A dynode array as claimed in claim 13 wherein said foils are substantially aluminum foils.

16. A dynode array as claimed in claim 15 wherein said aluminum foils are aluminum foils meeting the specification of International registered designation 1145.

17. A dynode array as claimed in claim 15 wherein said aluminum foils are formed from rolled sheets of aluminum material which have been heat treated at substantially 350° C. for a period between one and one half and two hours.

18. A dynode array as claimed in claim 17 wherein said foils have a composition complying with International registered designation 1145.

19. A dynode array is claimed in any one of claims 15 to 18 wherein said aluminum foil has a peak secondary electron yield, $\delta$, of substantially 3.8 or more.

* * * * *